US011175003B2

(12) United States Patent
Jeswani et al.

(10) Patent No.: US 11,175,003 B2
(45) Date of Patent: Nov. 16, 2021

(54) DOWNLIGHT HAVING QUICK CONNECT DRIVER ASSEMBLY WITH SWITCH SELECTABLE LIGHT CHARACTERISTICS

(71) Applicants: Anil Jeswani, Acton, MA (US); Renaud Richard, Manchester, NH (US); Ahmed Eissa, Cambridge, MA (US)

(72) Inventors: Anil Jeswani, Acton, MA (US); Renaud Richard, Manchester, NH (US); Ahmed Eissa, Cambridge, MA (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 16/846,462

(22) Filed: Apr. 13, 2020

(65) Prior Publication Data

US 2021/0317960 A1 Oct. 14, 2021

(51) Int. Cl.

| | |
|---|---|
| ***F21S 8/04*** | (2006.01) |
| ***F21S 8/02*** | (2006.01) |
| ***F21K 9/237*** | (2016.01) |
| ***F21S 9/02*** | (2006.01) |
| ***H05B 45/3575*** | (2020.01) |
| ***H05B 45/10*** | (2020.01) |
| *F21Y 115/10* | (2016.01) |

(52) U.S. Cl.

CPC ..... *F21S 8/026* (2013.01); *F21K 9/237* (2016.08); *F21S 9/02* (2013.01); *H05B 45/10* (2020.01); *H05B 45/3575* (2020.01); *F21Y 2115/10* (2016.08)

(58) Field of Classification Search

CPC .. F21S 8/026; F21S 9/02; H05B 45/10; H05B 45/3575; F21K 9/237

See application file for complete search history.

(56) References Cited

U.S. PATENT DOCUMENTS

| | | | | |
|---|---|---|---|---|
| 10,234,091 | B1 * | 3/2019 | Chaimberg | H05B 45/30 |
| 2014/0254177 | A1 * | 9/2014 | Danesh | F21S 8/026 362/363 |

* cited by examiner

*Primary Examiner* — Karabi Guharay

(74) *Attorney, Agent, or Firm* — Tutunjian & Bitetto PC

(57) ABSTRACT

A lamp is provided that includes a first housing having a recessed down lamp geometry for containing a light emitting diode (LED) light source, and a second housing for containing driver electronics including an exterior switch for selecting lighting characteristics of light being projected by the light emitting diode (LED) light source, wherein the first housing containing the light emitting diode (LED) light source and the second housing including the driver electronics are electrically connected through a reversible connector.

19 Claims, 14 Drawing Sheets

DOWNLIGHT HAVING QUICK CONNECT DRIVER ASSEMBLY WITH SWITCH SELECTABLE LIGHT CHARACTERISTICS

TECHNICAL FIELD

The present disclosure generally relates to lamp assemblies employing light emitting diodes as the light source, and lighting characteristics that can be selected by the user, and lighting installation methods.

BACKGROUND

One of the most common light fixtures for residential or commercial applications is the recessed can downlight (RCD), which is an open-bottom can that contains a light bulb, most commonly an incandescent bulb or a fluorescent bulb. The fixture is typically connected to the power mains at 120 to 277 volts, 50/60 Hz. RCDs are generally installed during the construction of a building before the ceiling material (such as plaster or gypsum board) is applied. Therefore, they are not easily removed or substantially reconfigured during their lifetime. Recently, lighting devices have been developed that make use of light emitting diodes (LEDs) for a variety of lighting applications. Owing to their long lifetime and high energy efficiency, LED lamps are now also designed for replacing traditional incandescent and fluorescent lamps. LED lamps are now designed in recessed can downlight (RCD) geometry for use in new construction or retrofit applications.

SUMMARY

In one aspect, a downlight is provided that includes a first housing having a recessed down lamp geometry for containing a light emitting diode (LED) light source, and a second housing for containing driver electronics including an exterior switch for selecting lighting characteristics of light being projected by the light emitting diode (LED) light source, wherein the first housing containing the light emitting diode (LED) light source and the second housing including the driver electronics are electrically connected through a reversible connector.

In another aspect of the present disclosure, a downlight is provided that includes a first housing having a recessed down lamp geometry for containing a light emitting diode (LED) light source, and a second housing containing driver electronics to power the light emitting diode (LED) light source and a junction box. The second housing is vertically orientated to provide that the driver electronics are positioned in a first level of the second housing and a junction box is present on a second level of the second housing to provide that a main power connection from the power source to the junction box and a driver to light source power connection are vertically offset from one another. The downlight further includes a reversible driver to light source connector for electrically connecting the first housing containing the light emitting diode (LED) light source and the second housing including the driver electronics.

In another aspect of the present disclosure, a lighting installation method is provided. The lighting installation method includes connecting a two level housing including a vertical stack of a driver electronics level and a junction box level to a main power source. The main power source is connected to a main power connector in the junction box level. The driver electronics level includes a first terminal. A power testing module is connected to the first terminal that is connected to the driver electronics level to determine whether the main power source is correctly connected to the main power source. The method may further include replacing the power testing module with a second terminal of a light engine housing. The first and second terminal are electrically connected to provide that the driver electronics are in electrical communication with a light engine within the light engine housing. In some embodiments, the first terminal is in electrical communication to driver electronics in the driver electronics level by wired connection. In some embodiments, the second terminal is in electrical communication to the light engine in the light engine housing by wired connection.

BRIEF DESCRIPTION OF THE DRAWINGS

The following description will provide details of embodiments with reference to the following figures wherein.

DETAILED DESCRIPTION

Figure 2:
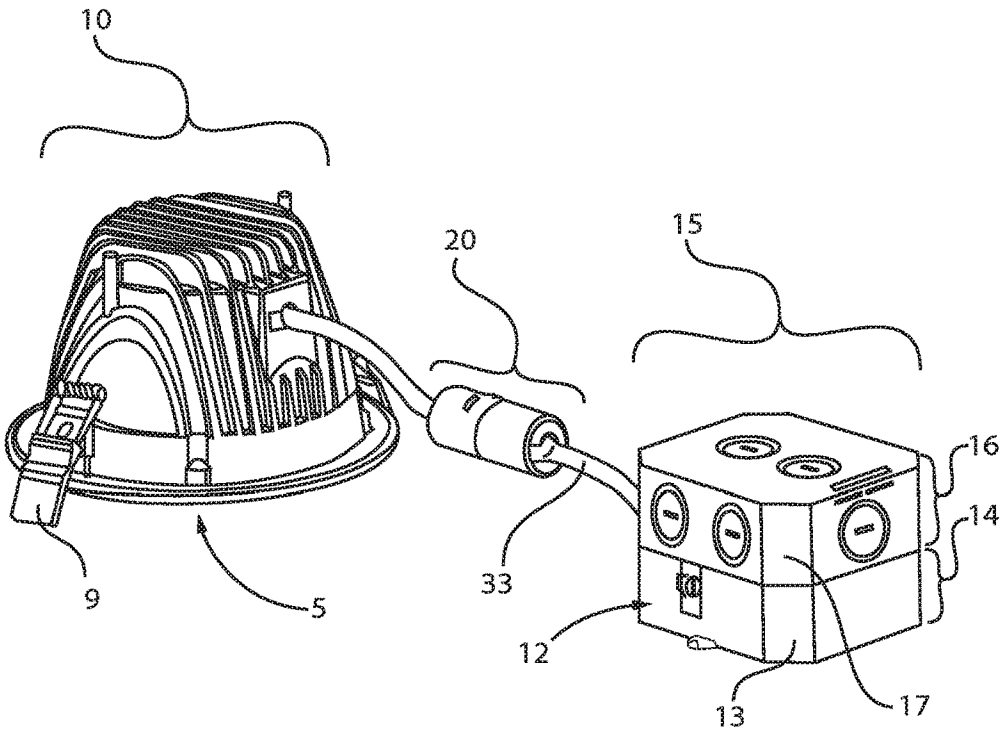
FIGS. 1 and 2 are perspective views of a downlight that includes a first housing having a recessed down lamp geometry for containing a light emitting diode (LED) light source, and a second housing for containing driver electronics including an exterior switch for selecting lighting characteristics of light being projected by the light emitting diode (LED) light source, wherein the first housing containing the light emitting diode (LED) light source and the second housing including the driver electronics are electrically connected through a reversible connector, in accordance with one embodiment of the present disclosure.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

In some embodiments, the present disclosure provides a downlight with selectable light characteristic settings, in which the settings can be selected by switches that are fixed to a housing containing the driver electronics for the downlight, in which the housing containing the driver electronics is physically separate from the housing containing the light source, e.g., light emitting diode (LED) light source for the downlight.

In some embodiments, the lighting structures provided by the structures and methods of the present disclosure may be employed in retrofit applications or new construction applications. In some embodiments, the methods and structures of the present disclosure provide a driver box (hereafter referred to a housing for driver electronics) that is separable from the reflector part of the lighting fixture so that it can be easily retrofitted in place for retrofit installation, or mounted to a new tray for installation in a new application. In lighting fixtures designs prior to the present disclosure, the housing for the driver electronics are generally integrated into the same housing that housed the reflector/light engine. In instances, in which the driver electronics are separated from the housing for the reflector/light engine in existing designs, they are interconnected, which requires that the installation of the downlight include both structures being installed at once. To install these prior designs, the installer must remove the tile/ceiling portion at which the light fixture will be installed.

In the lighting structures, and methods, of the present disclosure, the light engine/reflector of the fixture is present in a housing (first housing) that is separate from the housing (second housing) that contains the driver electronics, in which the two physically separate housings are electrically connected through a wired connection including a reversible connector. The reversible connector allows for the driver electronics and the light engine to be installed into the lighting location separately. This can provide for versatility between new construction and retrofit applications in a single product.

The housing including the light engine may be referred to as the light engine and reflector housing (sometimes referred to as the first housing). The housing including the driver electronics also include a junction box for the main power to the light assembly. The housing including the driver electronics may also include a light characteristic selecting switch on an exterior surface of the wall of the housing. The light characteristic that is being selected may be lumens or color correlated temperature (CCT), or other lighting characteristics. The methods and structures can provide for multiple installation options through the detachable, i.e., reversible, connection. The detachable, i.e., reversible, connection may be referred to as a quick connect connector. In some embodiments, by integrating a junction box with the housing that contains the driver electronics, the junction box is provided to the user, when the user obtains the light assembly. The junction box may be sufficiently large enough to allow for daisy chain connectivity of multiple light assemblies. In some embodiments, the junction box may also allow for connectivity of an auxiliary power source, such as a battery backup. In some embodiments, e.g., for retrofit applications, the light assembly of the first housing including the light engine and the separate second housing including the driver electronics may be installed into the ceiling from the room side (e.g., room side only installation) of the ceiling in a retrofit application. In other embodiments, the designs provided herein are applicable to new construction applications, in which both of the first housing for the light emitting diode (LED) light source and the second housing including at least the driver electronics are mounted to a metal tray. The light designs of the present disclosure are suitable for 120-277V applications and can be 0-10V dimmable. The light designs are suitable for other power sources, such as 347V, as well as others. In some embodiments, the light designs of the present disclosure may also be Digital Addressable Lighting Interface (DALI) form of dimming or phase cut dimming. The light designs may also be wirelessly dimmable.

The downlight structures of the present disclosure are now described with greater detail with reference to FIGS. 1-15.

Figure 1:
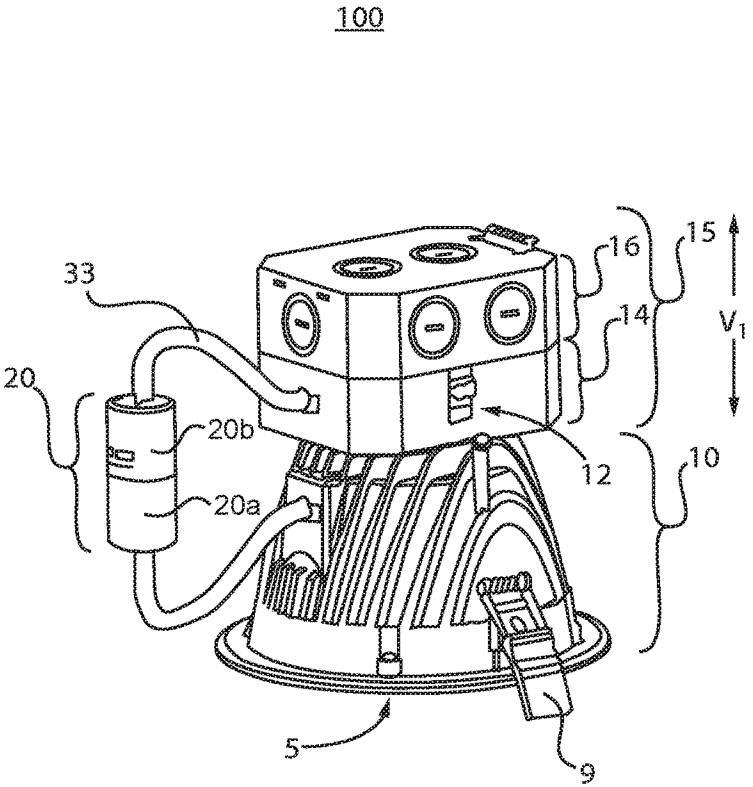
Figure 3:
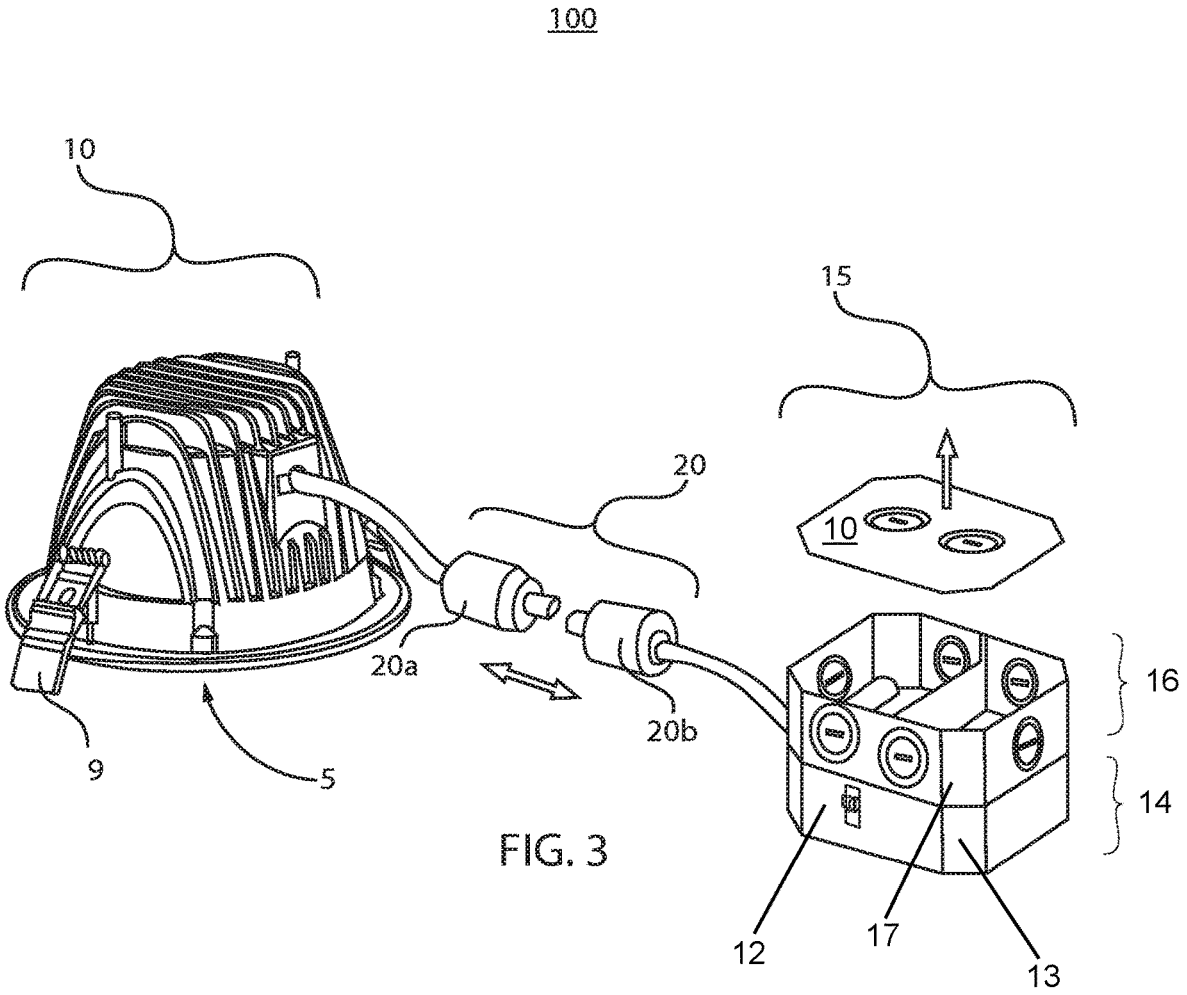
FIG. 3 is a perspective view of the downlight depicting the cover being removed from the junction box for the second housing including the driver electronics, and the connector being disconnected, in accordance with one embodiment of the present disclosure.

FIGS. 1-3 depict one embodiment of a downlight 100 including a light engine having a plurality of solid state light emitters, e.g., light emitting diodes (LEDs) 50. A "downlight", or recessed light, (also pot light in Canadian English, sometimes can light in American English) is a light fixture that is installed into a hollow opening in a ceiling. When installed it appears to have light shining from a hole in the ceiling, concentrating the light in a downward direction as a broad floodlight or narrow spotlight. "Pot light" or "canister light" implies the hole is circular and the lighting fixture is cylindrical, like a pot or canister.

Broadly, the lamp of the present disclosure is a downlight fixture that includes: 1) a two piece housing, 2) a reversible electrical connector connecting the two separate housings, 3) trim, and 4) a light engine. In some embodiments, the downlight 100 includes a first housing 10 having a recessed down lamp geometry for containing a light emitting diode (LED) light source; a second housing 15 for containing driver electronics including an exterior switch 12 for selecting lighting characteristics of light being projected by the light emitting diode (LED) light source; and a reversible driver to light source connector 20 for electrically connecting the first housing 10 containing the light emitting diode (LED) light source and the second housing 15 including the driver electronics.

It is noted that this is not an exclusive list of the elements of a downlight fixture. The trim 5 is the visible portion of the downlight. The trim 5 is the insert that is seen when looking up into the fixture, and also includes the thin lining around the edge of the light. The first housing 10 is the portion of the fixture that includes the reflector and the light engine, and is installed inside the ceiling and contains the lamp holder. It is noted that embodiments are contemplated in which the trim 5 and the first housing 10 are integrated together in one piece, and there are embodiments in which the trim 5 and the first housing 10 are separate components. There are many different types of light engines that can be inserted into recessed lighting fixtures, i.e., downlights 100. In accordance with the embodiments of the present disclosure, the light engines applicable to the methods and structures described herein include solid state emitters, such as light emitting diodes (LEDs). The second housing 15 contains the driver electronics and including a switch 12 for selecting lighting characteristics of light mounted on an exterior wall of the second housing 15. The second housing 15 is vertically orientated to provide that the driver electronics are positioned in a first level 14 of the second housing 15 and a junction box 17 is present on a second level 16 of the second housing 15 to provide that a main power connection from the power source to the junction box and a driver to light source power connection are vertically offset from one another.

Still referring to FIGS. 1-3, the light fixtures of the present disclosure further include a reversible driver to light source connector 20 for electrically connecting the first housing 10 containing the light emitting diode (LED) light source and the second housing 15 including the driver electronics. The two piece housings, e.g., a first housing 10 including the light emitting diode (LED) light source, and a second housing 15 including the driver electronics/junction box, connected by the reversible driver to light source connector 20 allows for the two housings to be separated to allow for installation in both new construction or retrofit applications.

The first housing 10 that contains the light emitting diode (LED) light engine may be composed of a metal, such as aluminum (Al), which provides for heat dissipation of any heat produced by the light engine. In some embodiments, to provide for increased heat dissipation, a plurality of ridges or fin structures may be integrated into the aluminum housing, e.g., first housing 10. In some embodiments, the first housing 10 may also be composed of a plastic, such a polycarbonate. The construction of the first housing 10 may fall into one of four categories for downlights that are recognized in North America. For example, the housing may be constructed for IC or "insulation contact" rated new construction housings are attached to the ceiling supports before the ceiling surface is installed. If the area above the ceiling is accessible these fixtures may also be installed from within the attic space. IC housings are typically required wherever insulation will be in direct contact with the housing. Non-IC rated new construction housings are used in the same situations as the IC rated new construction housings, only they require that there be no contact with insulation and at least 3 in (7.6 cm) spacing from insulation. These housings are typically rated up to 150 watts. IC rated remodel housings are used in existing ceilings where insulation will be present and in contact with the fixture. Non-IC rated remodel housings are used for existing ceilings where, no insulation is present. Non-IC rated remodel housings require that there be no contact with insulation and at least 3 in (7.6 cm) spacing from insulation. Sloped-ceiling housings are available for both insulated and non-insulated ceilings that are vaulted. It is noted that the first housing 10 of the downlight of the present disclosure may meet be designed to meet the requirements of any of the aforementioned standards. The first housing 10 is typically designed to ensure that no flammable materials come into contact with the hot lighting fixture.

The first housing 10 may be dimensioned to be available in various sizes based on the diameter of the circular opening where the downlight 100 is installed. In some examples, the circular opening of the first housing 10 may be sized in 6 and 8 inch diameter. It is noted that these dimensions are provided for illustrative purposes only and are not intended to limit the present disclosure. For example, the first housing 10 may also have a circular opening in diameters equal to 2 inches, 3 inches, 4 inches or 5 inches.

In some embodiments, the first housing 10 can also be "Air Tight", which means it will not allow air to escape into the ceiling or attic, thus reducing both heating and cooling costs.

The trim 5 of the downlight 100 is selected to increase the aesthetic appearance of the lamp. In some embodiments, the trim 5 may be a baffle that is black or white in color. In some embodiments, the trim 5 is made to absorb extra light and create a crisp architectural appearance. There are cone trims which produce a low-brightness aperture. In some embodiment, the trim 5 may be a multiplier that is designed to control the omnidirectional light from the light engine. Lens trim is designed to provide a diffused light. Lensed trims are normally found in wet locations. The luminous trims combine the diffused quality of lensed trim but with an open down light component. Adjustable trim allows for the adjustment of the light whether it is eyeball style, which protrudes from the trim or gimbal ring style, which adjusts inside the recess.

Figure 4:
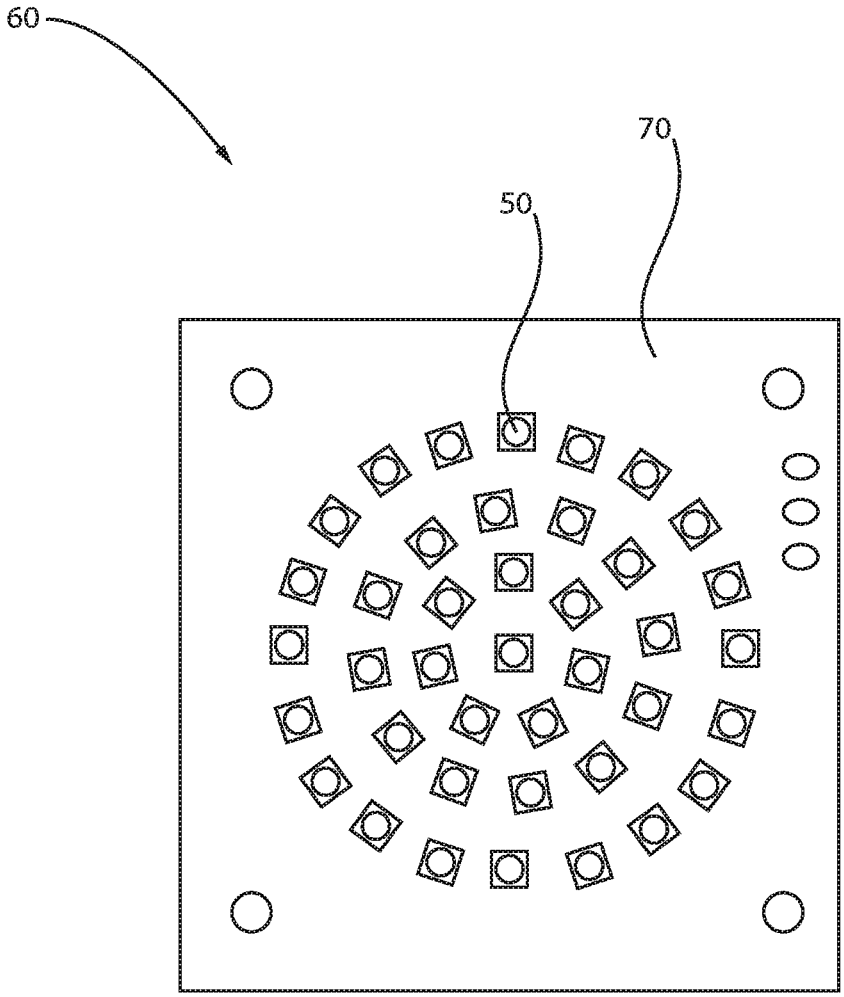
FIG. 4 is a top down view of a light emitting diode (LED) light engine including at least one string of light emitting diodes (LEDs) as used in the first housing of the lamp designs depicted in FIGS. 1-3.

FIG. 4 is a top down view of a light emitting diode (LED) light engine including at least one string of light emitting diodes (LEDs) as used in the first housing 10 of the downlight designs depicted in FIGS. 1-3. The light engine (also referred to as light source) is positioned within the housing 10 and orientated to emit light in a direction through opening of the housing 10 at which the trim 5 is positioned. The light engine produces light from solid state emitters.

The term "solid state" refers to light emitted by solid-state electroluminescence, as opposed to incandescent bulbs (which use thermal radiation) or fluorescent tubes, which use a low pressure Hg discharge. Compared to incandescent lighting, solid state lighting creates visible light with reduced heat generation and less energy dissipation. Some examples of solid state light emitters that are suitable for the methods and structures described herein include inorganic semiconductor light-emitting diodes (LEDs), organic light-emitting diodes (OLED), polymer light-emitting diodes (PLED) or combinations thereof. Although the following description describes an embodiment in which the solid state light emitters are provided by light emitting diodes, any of the aforementioned solid state light emitters may be substituted for the LEDs. FIG. 4 illustrates one example of the light emitting diodes (LEDs) 50 of a light engine 60 that can be utilized within the downlights 100 that are depicted in FIGS. 1-3.

Referring to FIG. 4, in some embodiments, the light source (also referred to as light engine) for the downlight 100 is provided by plurality of LEDs 50 that can be mounted to the circuit board 60 by solder, a snap-fit connection, or other engagement mechanisms. In some examples, the LEDs 50 are provided by a plurality of surface mount device (SMD) light emitting diodes (LED).

The circuit board 70 for the light engine 60 may be composed of a metal core printed circuit board (MCPB). MCPCB uses a thermally conductive dielectric layer to bond circuit layer with base metal (Aluminum or Copper). In some embodiments, the MCPCB use either Al or Cu or a mixture of special alloys as the base material to conduct heat away efficiently from the LEDs thereby keeping them cool to maintain high efficacy. In some embodiments, other materials, such as FR4 can also be employed.

It is noted that the number of LEDs 50 on the printed circuit board 70 may vary. For example, the number of LEDs 50 may range from 5 LEDs to 70 LEDs. In another example, the number of LEDs 50 may range from 35 LEDs to 45 LEDs. It is noted that the above examples are provided for illustrative purposes only and are not intended to limit the present disclosure, as any number of LEDs 50 may be present the printed circuit board 70. In some other examples, the number of LEDs 50 may be equal to 5, 10, 15, 20, 25, 30, 35, 40, 45, 50, 55, 60, 65 and 70, as well as any range of LEDs 50 with one of the aforementioned examples as a lower limit to the range, and one of the aforementioned examples as an upper limit to the range. In some embodiments, chip on board (COB) light emitting diodes may be used in the light engine.

The LEDs 50 may be arranged as strings on the printed circuit board 70. When referring to a "string" of LEDs it is meant that each of the LEDs in the string are illuminated at the same time in response to an energizing act, such as the application of electricity from the driving electronics, e.g., driver, in the downlight 100. The LEDs 50 in a string of LEDs are electrically connected for this purpose. For example, when a string of LEDs 50 is energized for illumination, all of the LEDs in the string are illuminated. Further, in some embodiments, illuminating the first string of LEDs 50 does not illuminate the LEDs in the second string of LEDs 50, and vice versa, as they are independently energized by the driving electronics, and not electrically connected. It is also noted that the same LED may be shared by more than one string.

In some embodiments, the LEDs 50 of the downlight 100 are selected to be capable of being adjusted for the color of the light they emit. The term "color" denotes a phenomenon of light or visual perception that can enable one to differentiate objects. Color may describe an aspect of the appearance of objects and light sources in terms of hue, brightness, and saturation. Some examples of colors that may be suitable for use with the method of controlling lighting in accordance with the methods, structures and computer program products described herein can include red (R), orange (O), yellow (Y), green (G), blue (B), indigo (I), violet (V) and combinations thereof, as well as the numerous shades of the aforementioned families of colors. It is noted that the aforementioned colors are provided for illustrative purposes only and are not intended to limit the present disclosure as any distinguishable color may be suitable for the methods, systems and computer program products described herein.

The LEDs 50 of the downlight 100 may also be selected to allow for adjusting the "color temperature" of the light they emit. The color temperature of a light source is the temperature of an ideal black-body radiator that radiates light of a color comparable to that of the light source. Color temperature is a characteristic of visible light that has applications in lighting, photography, videography, publishing, manufacturing, astrophysics, horticulture, and other fields. Color temperature is meaningful for light sources that do in fact correspond somewhat closely to the radiation of some black body, i.e., those on a line from reddish/orange via yellow and more or less white to blueish white. Color temperature is conventionally expressed in kelvins, using the symbol K, a unit of measure for absolute temperature. Color temperatures over 5000 K are called "cool colors" (bluish white), while lower color temperatures (2700-3000 K) are called "warm colors" (yellowish white through red). "Warm" in this context is an analogy to radiated heat flux of traditional incandescent lighting rather than temperature. The spectral peak of warm-colored light is closer to infrared, and most natural warm-colored light sources emit significant infrared radiation. The LEDs 50 of the lamps provided by the present disclosure in some embodiments can be adjusted from 2K to 5K.

The LEDs 50 of the downlight 100 may also be selected to be capable of adjusting the light intensity/dimming of the light they emit. In some examples, dimming or light intensity may be measured using lumen (LM). In some embodiments, the dimming or light intensity adjustment of the LEDs 50 can provide for adjusting lighting between 100 LM to 2000 LM. In another embodiment, dimming or light intensity adjustment of the LEDs 50 can provide for adjusting lighting between 500 LM to 1750 LM. In yet another embodiment, the dimming or light intensity adjustment of the LEDs 50 can provide for adjusting lighting between 700 LM to 1500 LM.

In some embodiments, the LED light engines 60 for the downlight may provide the that downlight be an SMD (Surface Mount Diode) downlight and/or a COB (Chip on Board) downlights. In some embodiments, the LEDs 50 may be selected to be SMD type emitters, in which the SMDs are more efficient than COBs because the light source produces higher lumens per watt, which means that they produce more light with a lower wattage. In some embodiments, the SMD type LEDs 50 can produce a wider beam of light which is spread over a greater area when compared to light engines of COB type LEDs. This means that less material is needed for the heat sink, which in turn means that they are more economical. SMD downlights can be covered with a frosted reflector which hides the LED chip array, and spreads the light evenly. SMD downlights can produce a wide spread of light. In some example, the wide beam angle of the light emitted from SMD downlights means they can be suitable for larger rooms like living rooms, bedrooms, kitchens and bathrooms.

A Chip On Board (COB) LED Downlight consists of a single LED chip, mounted on the downlight, compared to an array of LED's like an SMD. COB LEDs are basically multiple LED chips (typically nine or more) bonded directly to a substrate by the manufacturer to form a single module. The ceramic/aluminum substrate of COB LEDs also acts as a higher efficiency heat transfer medium when coupled to an external heatsink, further lowering the overall operating temperature of the assembly. Since the individual LEDs used in a COB are chips, the chips can be mounted such that they take up less space and the highest potential of the LED chips can be obtained. When the COB LED package is energized, it appears more like a lighting panel than multiple individual lights as would be the case when using several SMD LEDs mounted closely together. In some embodiments, because the single cluster of LED's 50 are mounted in one point, they can require greater cooling, so a heat sink, usually made of aluminum, may be mounted to dissipate the heat.

A light engine of COB type LEDs 50 can provide a more focused light and with the use of reflectors, the light beam can be more controlled when compared to a light engine that is composed of SMD LEDs. Chrome reflectors surrounding the diode can be replaced and set at different angles to make the light beam narrower or wider. Due to the narrow beam and with the use of reflectors that are usually clear, COB lights generate crisper and cleaner as there is no frosting on the lenses, which cuts down the clarity of the LED light. Due to the clear lenses, more light can penetrate further which means they perform well in rooms with high ceilings.

It is noted that the above description of the light emitting diodes (LEDs) 50 is provided for illustrative purposes only, and is not intended to limit the present disclosure. For example, In some embodiments, other light sources may either be substituted for the LEDs 50, or used in combination with the LEDs 50, such as organic light-emitting diodes (OLEDs), a polymer light-emitting diode (PLED), and/or a combination of any one or more thereof.

Figure 5:
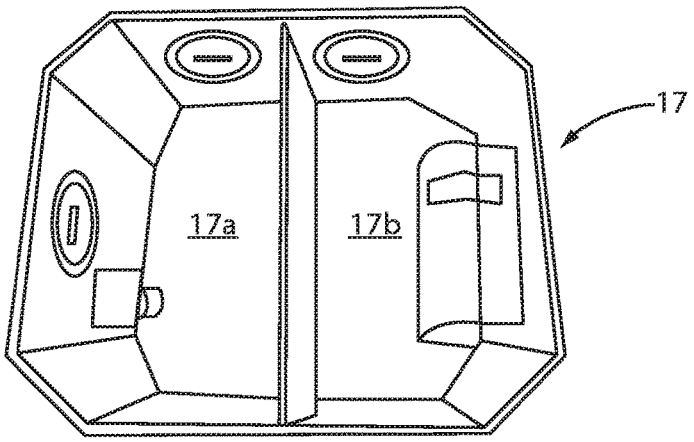
FIG. 5 is a perspective view of an interior of a junction box for the second housing including the driver electronics.

Referring to FIGS. 1-8, the second housing 15 of the downlight may include the driver electronics (which are further described below with reference to FIG. 8) and a junction box 17. FIG. 3 illustrates one embodiment of the second housing 15, in which the cover 18 is removed to expose an internal surface of the junction box 17 of the second level 16 of the second housing 15. FIG. 5 illustrates one embodiment of the internal surfaces of a junction box 17 includes two compartments 17*a*, 17*b*. The sidewalls of the junction box 17 includes a plurality of knock-out openings. A "knock out" or "KO" is a partially stamped opening in electrical enclosures that allows quick entry of a wire, cable or pipe via connector or fitting to the interior. The knock out, e.g., openings, each lead to one of the compartments 17*a*, 17*b* of the junction box. In some embodiments, at least one of the compartments 17*a*, 17*b* of the junction box is for a main power connection. In some embodiments, at least one of the compartments 17*a*, 17*b* are for the connection to a dimming circuit. In some further embodiments, the compartments 17*a*, 17*b* for the junction box may also include connections for an auxiliary power module, such as an emergency backup battery. The compartments 17*a*, 17*b* are sufficiently large to allow for light assemblies to be daisy chained together. In one embodiment, the compartments 17*a*, 17*b* may each of a volume of 10 cubic inches or greater. This is only one example, and other examples are equally applicable. For example, the compartments 17*a*, 17*b* may have a volume ranging from 9 cubic inches to 15 cubic inches. In one example, the compartments 17*a*, 17*b* have a volume of 12 cubic inches. The junction box 17, as well as, the entirety of the second housing may be composed of a plastic, such as polycarbonate. In some embodiments, the second housing 15 may be composed of a metal.

The second housing 15 is vertically orientated to provide that the driver electronics are positioned in a first level 14 of the second housing 15 and a junction box is present on a second level 16 of the second housing 10. The junction box is hereafter referred with reference number 17, and provides the connection point for a main power connection from the power source. The driver electronics portion of the box is referred to with reference number 13, and provides the connection point for the driver to light source power connection. Referring to FIGS. 1-8, the second housing is vertically orientated to provide that the driver electronics 13 are positioned in a first level 14 of the second housing 15, and a junction box 17 is present on a second level 16 of the second housing 15 to provide that a main power connection from the power source to the junction box and a driver to light source power connection are vertically offset VI from one another. By "vertically offset" it is meant that the connection point for the main power at the junction box portion of the second housing 15 is on a different plane than the connection point at the electronics drive 17 portion of the second housing 10. The electrical connections for the main power to the junction box portion of the second housing 15 may be through openings (also referred to as punch outs) that are formed through sidewalls of the second housing 15.

Figure 6:
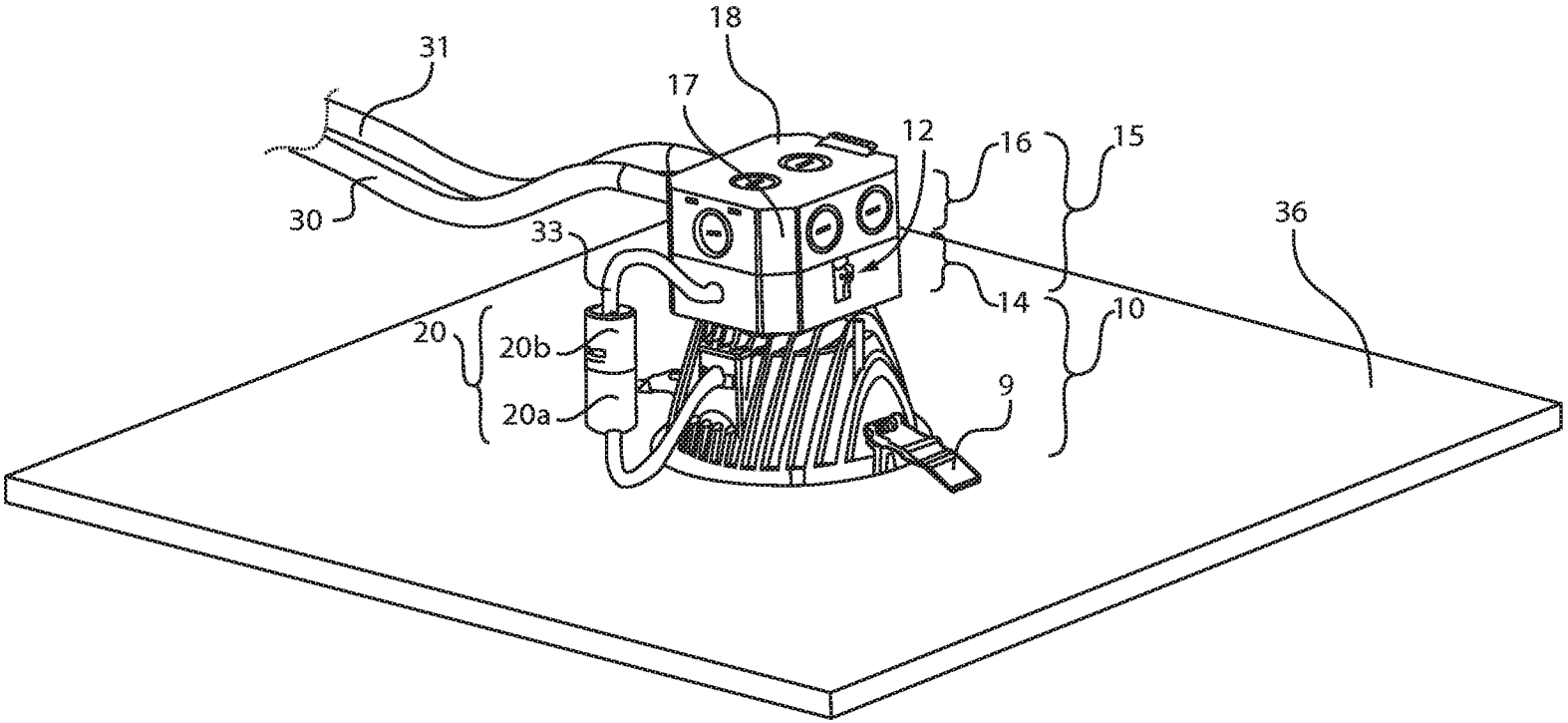
FIG. 6 is a perspective view of a downlight as depicted in FIGS. 1 and 2 being installed in a retrofit application, in accordance with one embodiment of the present disclosure.
Figure 7:
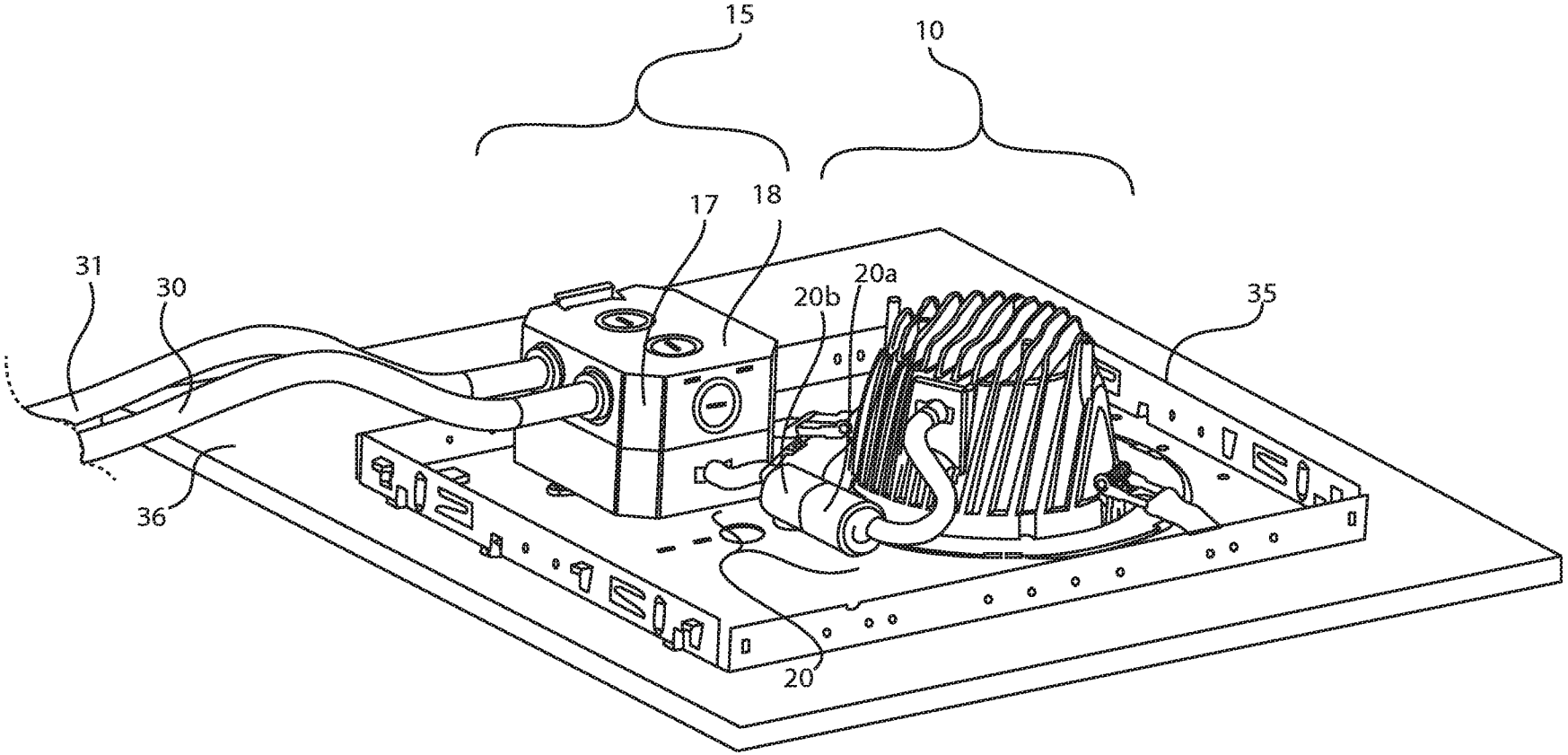
FIG. 7 is a perspective view of a downlight as depicted in FIGS. 1 and 2 being installed in a new construction application, in accordance with one embodiment of the present disclosure.
Figure 8:
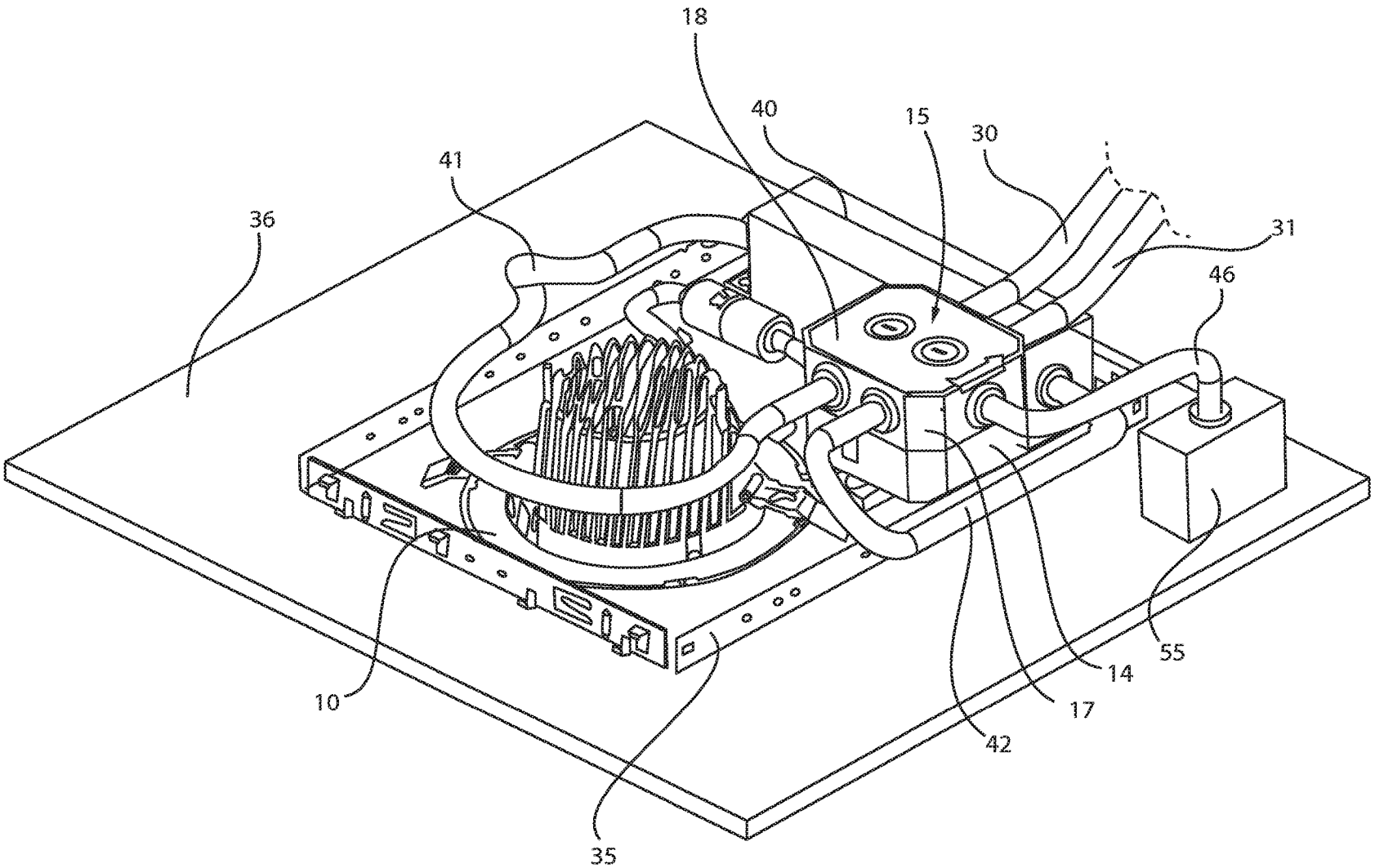
FIG. 8 is a perspective view of a downlight as depicted in FIGS. 1 and 2 further including an auxiliary power source, in accordance with one embodiment of the present disclosure.

Referring to FIGS. 6, 7 and 8, the main power wire is identified by reference number 30 and enters the second level 16 of the second housing 15, which is the junction box 17 portion of the second housing 15. The main power wire 30 may provide to the downlight a universal input voltage, e.g., a voltage ranging from 120V to 277V. In some further examples, the main power wire 30 may provide an input voltage of 347V. An input voltage of 120-277V can be suitable for commercial applications. Referring to FIGS. 6, 7 and 8, in some embodiments, the input voltage can be 120V, which can be suitable for both residential and commercial applications. Referring to FIGS. 6, 7 and 8, in addition to the main power wire 30, the junction box 17 may also include a connection for dimming controls, i.e., dimming wire connection, in which the wiring for dimming is identified by reference number 31. In some embodiments, the downlight 100 described herein may have a diming wire 31 that provides for 0-10V and phase dimmable applications. Referring to FIG. 8, in some embodiments, the junction box 17 may also include connections for auxiliary power 40, such as a battery backup, e.g., emergency battery backup.

Referring to FIGS. 1-3 and 5-8, in some embodiments, the second housing 15 includes at least one switch 12 for selecting a light characteristic for the light projected by the light emitting diode (LED) light source of the first housing 10. The at least one switch 12 for selecting the light characteristic may select at least one of a lumen setting and/or a correlated color temperature (CCT) setting for the light being emitted by the light engine of the downlight. In FIGS. 1-3 and 5-8, the at least one switch 12 is a single switch for selecting the lumens of the light being projected by the light engine. The single switch 12 for selecting the lumens of light being projected by the light engine may include three light settings for the lumens. For example, a light engine in a 6" housing, e.g., first housing 10, for a light source being powered by a selectable power setting of 8 watts, 10 watts, or 12 watts may have three lights settings of 700 lumens, 900 lumens and 1100 lumens, respectively, in which the three light settings are selected using the single switch 12. In another example, a light engine in a 6" housing, e.g., first housing 10, for a light source being powered by a selectable power setting of 12 watts, 14 watts, or 16 watts may have three lights settings of 1100 lumens, 1300 lumens and 1500 lumens, respectively, in which the three light settings are selected using the single switch 12. In yet another example, in which the light emitting diode (LED) light engine is present in a housing, e.g., first housing 10, having an 8" diameter, the light source can be powered by a selectable power setting of 11 watts, 16 watts, or 21 watts may have three light settings of 1000 lumens, 1500 lumens and 2000 lumens, respectively, in which the three light settings are selected using the single switch. In an even further example, in which the light emitting diode (LED) light engine is present in a housing, e.g., first housing 10, having an 8" diameter, the light source can be powered by a selectable power setting of 31 watts, 41 watts, or 51 watts may have three light settings of 3000 lumens, 4000 lumens and 5000 lumens, respectively, in which the three light settings are selected using the single switch.

In some embodiments, the at least one switch 12 for selecting each of the settings may be a toggle switch, a pushbutton switch, and/or a selector switch. Toggle switches are actuated by a lever angled in one of two or more positions. Pushbutton switches are two-position devices actuated with a button that is pressed and released. Selector switches are actuated with a rotary knob or lever of some sort to select one of two or more positions. Like the toggle switch, selector switches can either rest in any of their positions or contain spring-return mechanisms for momentary operation. It is noted that the above examples are provided for illustrative purposes only, and are not intended to limit the types of switches that are to be used in accordance with the present disclosure. Any switch used to interrupt the flow of electrons in a circuit can be suitable for use as a switch 12 for selecting settings for the lumen output of the light emitted by the downlight and/or selecting the correlated color temperature (CCT) of the light emitted by the downlight 100. In one example, a simplest type of switch is one where two electrical conductors are brought in contact with each other by the motion of an actuating mechanism.

In one embodiment, the downlight includes at least two switches 12, e.g., a first switch for selecting at least one lumen setting for the light emitted by the light engine; and a second switch for selecting at least one correlated color temperature (CCT). Examples of different light settings for the first switch directed to different lumen levels have been described above. Examples of different correlated color temperature (CCT) settings for the second switch may include a first correlated color temperature (CCT) setting of 2700K, a second correlated color temperature (CCT) setting of 3500K, and a third correlated color temperature (CCT) setting 4000K.

It is noted that the number of selectable settings can be provided by the at least one switch 12 that is depicted in FIGS. 1-8. For example, the number of selectable settings that may be selected using the at least one light switch may be equal to 2, 3, 4, 5, 6, 7, 8, 9 and 10, as well as any range for the number of selectable settings including a lower limit provided by one of the aforementioned examples, and an upper limit provided by one of the aforementioned examples. Further, the values for the selectable settings, e.g., lumen settings and correlated color temperature (CCT) settings, are not limited to those described above and depicted in FIGS. 1-7.

For example, in addition to the above described lumen levels, the at least one switch may select at least one lumen setting, e.g., selected from 500 LM, 600 LM, 700 LM, 800 LM, 900 LM, 1000 LM, 1100 LM, 1200 LM, 1300 LM, 1400 LM, 1500 LM, 1600 LM, 1700 LM, 1800 LM, 1900 LM and 2000 LM, as well as any range for the lumens associated with the light emitted by the downlight including a lower limit provided by one of the aforementioned examples, and an upper limit provided by one of the aforementioned examples.

For example, the at least one switch 12 may select at least one correlated color temperature (CCT) setting selected from 2500K, 2600K, 2700K, 2800K, 2900K, 3000K, 3100K, 3200K, 3300K, 3400K, 3500K, 3600K, 3700K, 3800K, 3900K, 4000K, 4100k, 4200K, 4300K, 4400K and 4500K, as well as any range for the correlated color temperature (CCT) associated with the light emitted by the downlight including a lower limit provided by one of the aforementioned examples, and an upper limit provided by one of the aforementioned examples.

The at least one switch 12 may be mounted to the sidewall of the second housing 15 on the first level 14 of the second housing 15. For example, the at least one switch 12 may be mounted proximate to the driver electronics, e.g., on the same level, as the driver electronics. This provides that the at least one switch 12 is in electrical communication with the driver electronics, which are in turn in electrical communication with the light engine that is contained in the first housing 10. The driver electronics in the second housing 15 are in electrical communication through the reversible driver to light source connector 20.

In some embodiments, in addition to the light engine being in electrical communication with the at least one switch 12 for selecting lighting characteristics, the light engine may also be in electrical communication with a receiver for receiving setting commands for dimming and intensity of the light being emitted by the downlight. In some embodiments, the dimming function may be controlled through a 0-10V dimming wall switch. The 0-10V dimming wall switch is remotely mounted from the housing 10 of the downlight 100. The 0-10V dimming wall switch communicates with a 0-10V dimming circuit 206 in the electronics package 200 of the downlight 100.

In some embodiments, the second housing 15, e.g., junction box/electronic driver box, is separable from the first housing 10, e.g., light engine/reflector, so that the junction box/electronic driver box can be easily retrofitted in place or mounted to a new tray in new construction. To provide that the second housing 15 is separable from the first housing 10, a reversible driver to light source connector 20 is provided for electrically connecting the first housing 10 containing the light emitting diode (LED) light source and the second housing 20 including the driver electronics. In some embodiments, the reversible driver to light source connector 20 is a connector having a first terminal 20*a* that is engaged to the light emitting diode (LED) light source in the first housing 10 and a second terminal 20*b* that is engaged to the driver electronics in the second housing 15. In some embodiments, the first terminal 20*a* is a male terminal, and the second terminal 20*b* is a female terminal. In some embodiments, the first terminal 20*a* is a female terminal, and the second terminal 20*b* is a male terminal. In one embodiment, the first and second terminals 20*a*, 20*b* screw together to provide the electrical connection. The first and second terminals 20*a*, 20*b* may then be screwed apart in an opposite direction from which they were screwed together. Generally, the first and second terminals include a housing containing terminal contacts. In some embodiments the housings for the first and second terminals are threaded to provide that they can be screwed together. In other embodiments, the first and second terminals 20*a*, 20*b* are provided by terminal blocks, such as terminal blocks with screw terminals, terminal blocks with barrier terminals, terminal blocks with push-fit terminals, terminal blocks with pluggable terminals and combinations thereof.

One of the male terminal and the female terminal is engaged through wired connection to the light emitting diode (LED) light engine in the first housing 10, while the other of the male terminal and the female terminal is engaged through wired connection to the driver electronics of the second housing 15. Referring to FIG. 1, the wired connection from the driver electronics of the second housing 15 that is terminated with the second terminal 20*b* is present through knockout in the first level 14 of the second housing 15 is vertically offset from the knockout that the power line 31 is present through the second level 16 of the second housing 15, which provides the junction box 17.

As noted, in some embodiments, the second housing 15, e.g., junction box/electronic driver box, is separable from the first housing 10, e.g., light engine/reflector, so that the junction box/electronic driver box can be easily retrofitted in place, as depicted in FIG. 6, or mounted to a new tray in new construction, as depicted in FIG. 7. For example, FIG. 6 illustrates one embodiment of the downlight 100 being installed in a retrofit application. In this application, the second housing 15 may be positioned, i.e., vertically stacked, atop the first housing 10. In this embodiment, the second housing 15 is mounted to a back surface of the first housing 10 so that the driver electronics is positioned between the junction box 17 and the first housing 10. This is a retrofit application, because the assembly of the vertically stacked first housing 10 and the second housing 15 is positioned into the ceiling through the hole that an original light assembly that is being replaced is removed through. In this application, the retrofit assembly can be installed into the ceiling from the room side of the ceiling panel 36.

FIG. 7 illustrates a new construction application for the light assembly 100. In the embodiment that is depicted in FIG. 7, the first housing 10 is mounted to first portion of a mounting bracket 35 affixed to a ceiling panel 36, and the second housing 15 is mounted to a second portion of the mounting bracket 35 that is affixed to the ceiling panel 36.

FIG. 8 illustrates one embodiment of a light assembly 100 including an auxiliary backup power 40. In some embodiments, a backup battery 40 is connected to the driver electronics that is present in first level 14 of the second housing 15. In some embodiments, the connection between the backup battery 40 and the driver electronics in the first level 14 of the second housing 15 is provided by a first side of backup power wiring 41 extending from the backup battery 40 through the electrical pathway opening in the junction box 17, which is at the second level 16 of the second housing 10. From the second level 16 of the housing, which provides the junction box 17, a connection is made which extends within the interior of the second housing to the driver electronics at the first level 14. The first side of the backup power wiring portion 41 of the backup battery 40 to the driver circuitry of the luminaire 100, so that when the primary power line 30 fails to power the light engine of the luminaire 100, suitable power for energizing the light emitting diodes (LEDs) of the light engine 60 is provided by the backup battery 40. In this embodiment, a second side of the backup power wiring 42 extends from the battery backup 40 back to the junction box 17 to hook up with the driver electronics in a way that provides that the backup battery 40 can power the light engine in the first housing 10 in the event that the primary power provided by the main power line 30 goes out.

The units including the backup battery 40 may also contain their own driver, not just a battery that regulates the current delivered to the light engine. The term "battery" can denote a structure, e.g., container, consisting of one or more cells, in which chemical energy is converted into electricity and used as a source of power. In some embodiments, the battery backup 40 may be a lithium iron phosphate ($LiFePO_4$) composition type battery. Lithium Iron Phosphate ($LiFePO_4$, LFE) is a kind of Li-Ion rechargeable battery for high power applications. LFP cells feature with high discharging current, non-explosive, long cycle life (>2000@0.2 C rate, IEC Standard), but its energy density is lower than normal Li-Ion cell (Li—Co) (higher NiMH cell). In other embodiments, the composition of the backup battery 40 may be Lithium-Manganese Oxide Battery, Lithium-Nickel Manganese Cobalt Oxide Battery, Lithium-Titanite Battery, Lithium-Cobalt Oxide Battery or combinations thereof. It is not required that the battery composition be a lithium containing composition. For example, the battery composition may be composed of a nickel cadmium (NiCd) composition, a nickel metal hydride (NiMH) composition, combinations thereof or other like compositions. In one example, the backup battery 40 has a type that is $LiFePO_4$ with 9.6 VDC.

The backup battery 40 may have an output current ranging from 100 mA to 1050 mA. The backup battery 40 may have an output voltage ranging from 11V to 56V. The backup battery 40 may have an output power equal to 25 W MAX. The backup battery 40 can have an input voltage of 90-305 VAC 50/60 Hz. The input current of the backup battery 40 can be 150 mA MAX. The recharge power can be 8 W MAX. It is noted that the aforementioned performance characteristics for the backup battery 40 are provided for illustrative purposes only, and are not intended to limit the disclosure to only these examples.

FIG. 8 also depicts one embodiment of junction box 17 in electrical communication, e.g., across test wiring 46, to a test switch 55.

Figure 9:
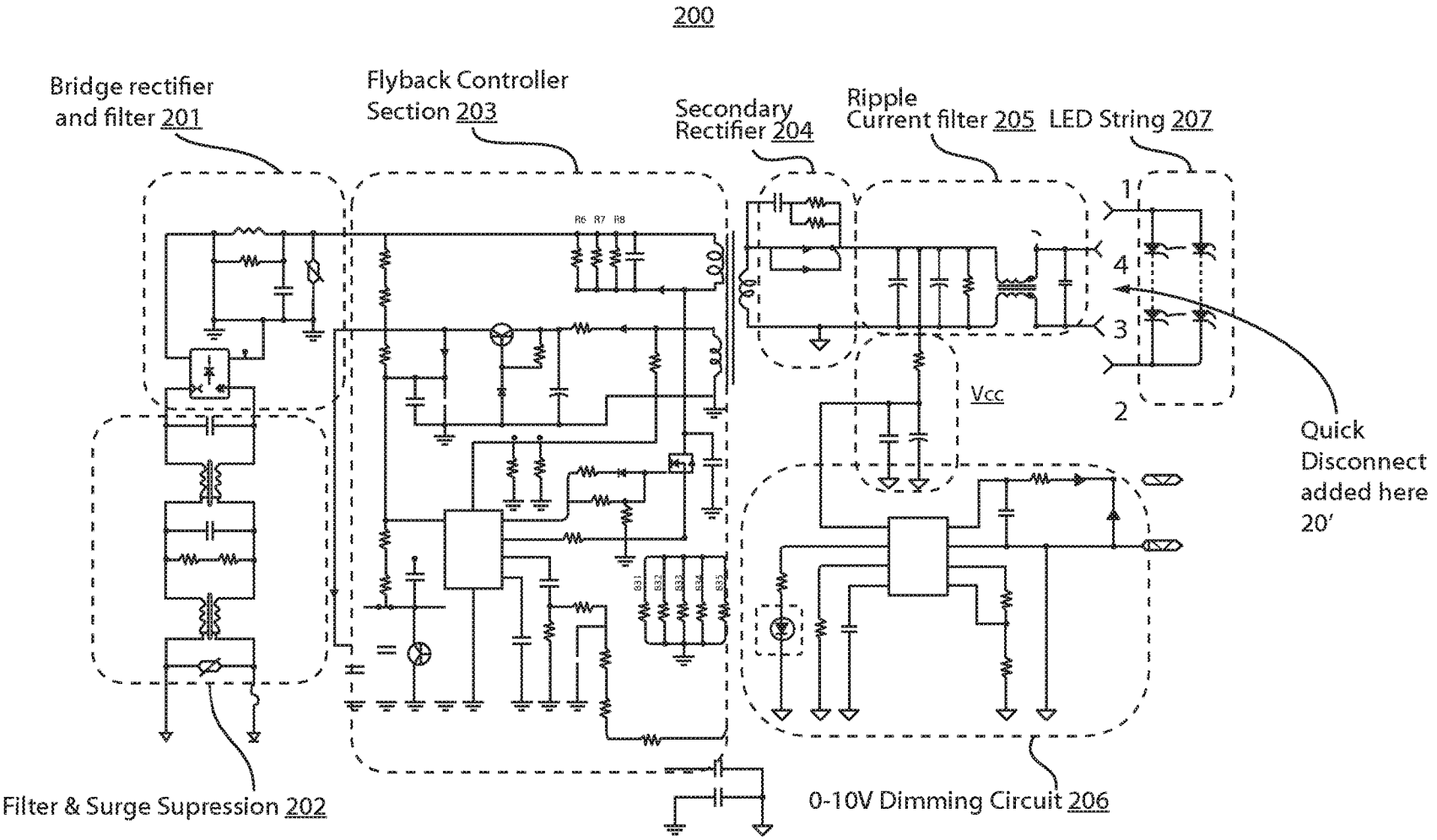
FIG. 9 is a circuit diagram for the electronics package of one embodiment of the downlight designs that is depicted in FIGS. 1-8.

FIG. 9 is a circuit diagram illustrating the electrical connectivity of the reversible driver to light source connector 20 for electrically connecting the first housing 10 containing the light emitting diode (LED) light source and the second housing 15 including the driver electronics. In some embodiments, the electronics package 200 for the downlight may include: an EMI filter and surge protection circuit 202, bridge rectifier and filter circuit 201, flyback controller circuit 203, secondary rectifier circuit 204, ripple current filter circuit 205, 0V-10V dimming circuit 206, and LED strings 207. FIG. 9 illustrates that the reversible driver to light source connector 20 is present between the ripple current filter circuit 205 and the LED strings 207 at the interface identified by reference number 20'.

The EMI filter and surge protection 202 portion of the electronics package 200 includes an EMI filter to filter the high frequency noise generated by the flyback converter from entering the mains input terminals of line and neutral. The surge protector protects the luminaire from the surge caused by events such as lightning and disturbances on the mains grid. The surge protector absorbs the energy and limits the peak voltage to a safe level.

The bridge rectifier and filter circuit 201 portion of the electronics package 200 includes a bridge rectifier that rectifies the AC input voltage into a pulsating DC voltage. The filter filters the high frequency noise.

The flyback controller section 203 of the electronics package 200 contains the flyback transformer, switch, flyback controller, starting resistor, secondary rectifier and ripple current filter. This section of the electronics package 200 generates the required voltage and current as per the need of the LED strings 207. This section also provides the necessary isolation between the input and output.

The 0 to 10V dimming circuit 206 is the section accepts the input from the 0 to 10V dimmer and generates corresponding signal for the Secondary Current Sensing and Dimming. This enables the change of output current from power supply going into LEDs to be controlled by the external 0 to 10V dimmer. The 0-10V dimming circuit 206 is in electric communication with a 0-10V dimming wall switch. The 0-10V dimming circuit 206 is in electrical communication with the LEDs 207. The 0-10V dimming circuit 206 may be referred to as a 0-10 dimmable LED driver. In lighting control applications, "0-10" describes the use of an analog controller to adjust the voltage in a 2-wire (+10 VDC and Common) bus connecting the controller to one or more LED drivers equipped with a 0-10 VDC dimming input. A 0-10 dimmable LED driver includes a power supply circuit that produces approximately 10 VDC for the signal wires and sources an amount of current in order to maintain that voltage. The controlled lighting should scale its output so that at 10 V, the controlled light should be at 100% of its potential output, and at 0 V it should at the lowest possible dimming level.

A 0-10V LED dimmable driver designs with a control chip. The 0-10V voltage changes, the power supply output current will change. For example, when the 0-10V dimming signal modulates to 0V, the output current will be 0, the brightness of the light will be off, when the 0-10V dimming modulates to maximum 10V, the output current will reach 100% power output, the brightness will be 100%.

The LED string 207 portion of the electronics package 200 includes the circuitry to the number of LEDs, and the number of LED strings. The LED type, e.g., color temperature, can be chosen based on the requirement for the light output characteristics. These LED strings are driven by the voltage and current generated by the flyback converter and they generate the required optical characteristics.

Referring to FIG. 9, in some embodiments, the driver may be a single-channel or multi-channel electronic driver configured to drive the solid state light emitters, e.g., LEDs, utilizing pulse-width modulation (PWM) dimming or any other suitable standard, custom, or proprietary driving techniques. As further shown in FIG. 9, the driver may include a controller.

In another aspect, a lighting method is provided, as depicted in FIGS. 10-15. The lighting method includes selecting a light characteristic to be projected by a light source, e.g., light emitting diode (LED) light engine, that is present in a first housing 10 having a recessed downlight can geometry. Selecting the light characteristic includes setting a switch 12 to the light characteristic. The switch 12 is present on a second housing 15 containing the driver electronics and having a main power connection, e.g., the main power connection is for electrical contact to the main power line 31. The first housing 10 and the second housing 15 are reversibly connected by a reversible driver to light source connector 20. Separating the first housing 10 and second housing 15 allows for the second housing 15 including the driver electronics to be installed in the ceiling separately from the first housing 10.

Figure 10:
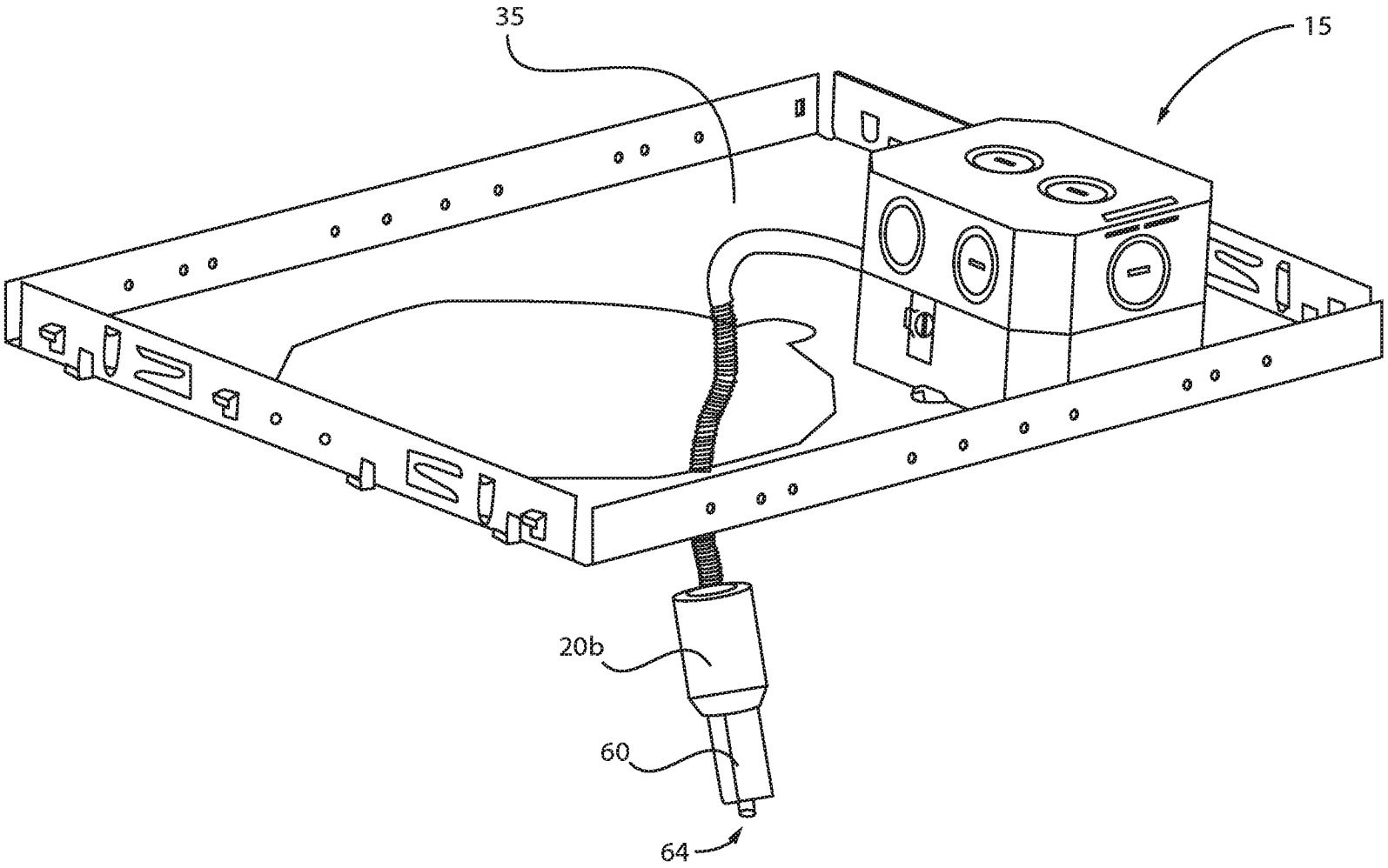
FIG. 10 is a perspective view of a second housing including the driver electronics mounted in a lighting fixture position, in which the first housing has been removed by disconnecting the reversible driver to light source connector, and a testing module has been connected into electrical connection with the second housing, in accordance with one embodiment of the present disclosure.

FIG. 10 illustrates the first housing 10 being installed in a ceiling. In FIG. 10, the first housing 10 is installed to a tray 35, in which the tray 35 is engaged to a ceiling panel 36. It is noted that this is only one embodiment of the present disclosure. The tray 35 may be omitted. For example, the method is equally applicable to the embodiments depicted in FIGS. 1-3 and 6, in which the tray is omitted, and the engagement of the light assembly is through the first housing 10 having clamps 9 for engaging the perimeter of the opening in the ceiling panel 36. In some embodiments, FIG. 10 illustrates the light assembly including the second housing 15 remaining in the ceiling after the first housing 10 has been disconnect from the second housing 15 and removed. This could be a step of a retrofit application. Separating the first and second housings 10, 15 allows for the main power connection, e.g., through main power line 30, to be made to the driver electronics in the second housing 15 without the first housing 10 including the light emitting diode (LED) light engine being present to possibly obstruct the installer from accessing the power lines for connection to the junction box 17 in the second level 16 of the second housing 15.

Figure 11:
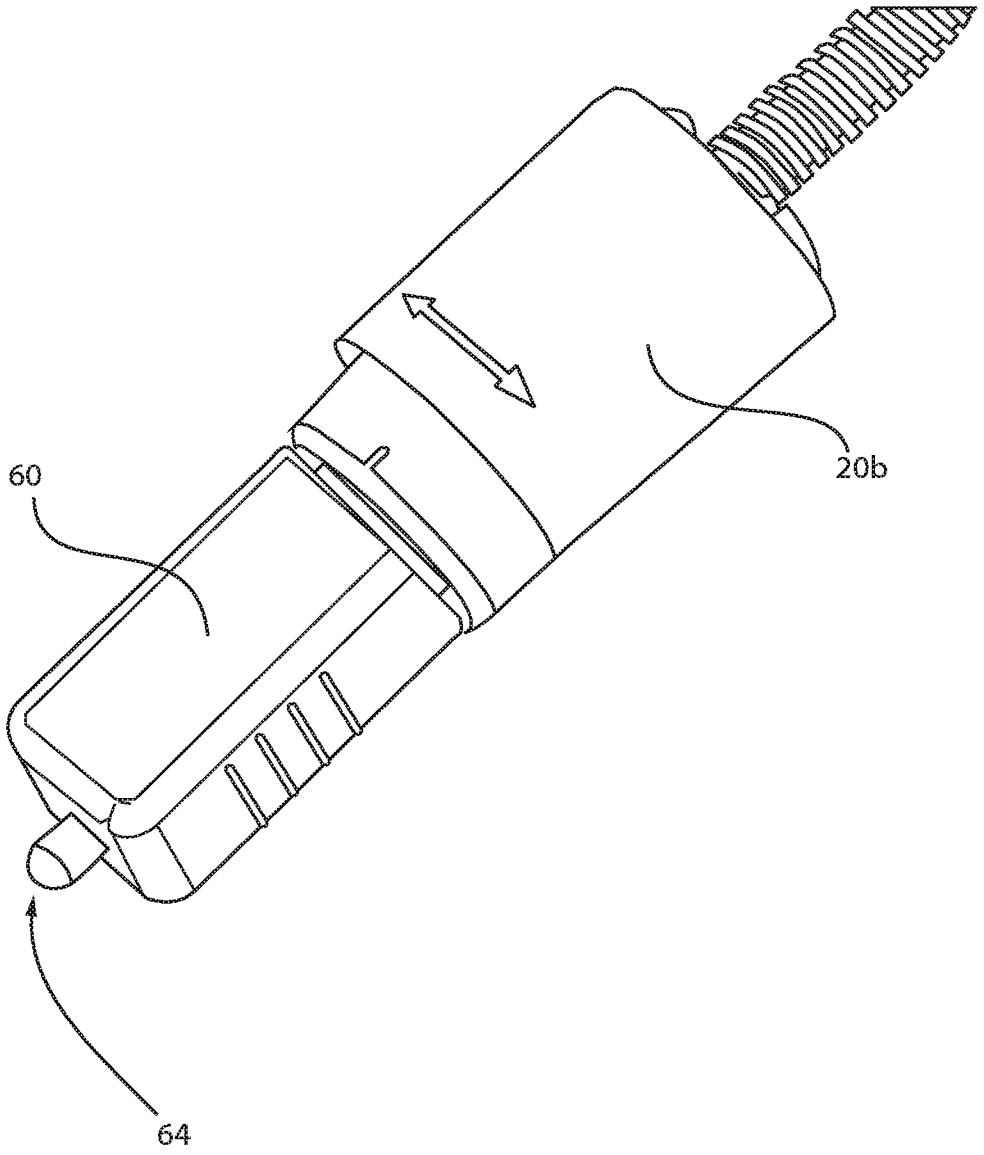
FIG. 11 is a perspective view of a testing module connected to the portion of the reversible driver to light source connector engaged to the second housing including the driver electronics.

Thereafter, the sufficiency of that main power connection may be tested through the second terminal 20*b* that is engaged to the driver electronics in the second housing 15. More specifically, a test module 60 can be connected to the second terminal 20*b* that provides a measurement of the electrical connection of the main power line 30 to the junction box 17 of the second housing 15. The test module 60 is depicted in FIG. 10 from the perspective of ceiling down. FIG. 11 is a magnified view of the test module 60 being engaged to the second terminal 20*b*. In some embodiments, the test module 60 includes a test light 64. In this example, whether the test light 64 is illuminated or not when the test module 60 is engaged to the second terminal 20*b* of the reversible driver to light source connector 20. The test light 64 may be a light emitting diode (LED).

Figure 12:
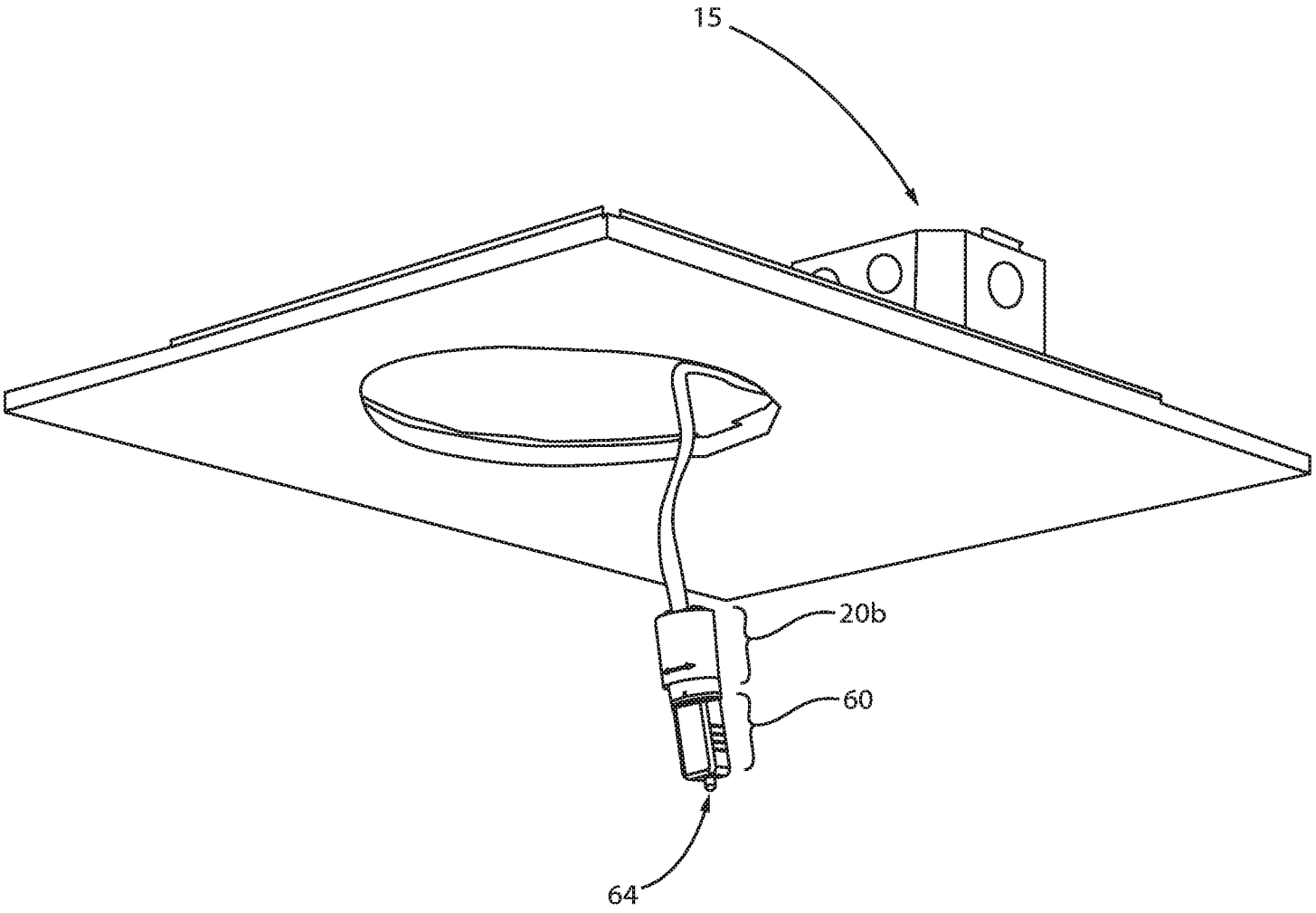
FIG. 12 is a perspective view of a testing module connected to the portion of the reversible driver to light source connector engaged to the second housing including the driver electronics, in which the second housing is mounted in the ceiling and the testing module is extending through the opening in the ceiling for engagement by the first housing including the light emitting diode (LED) light source.

Referring to FIGS. 10, 11 and 12, inspection can be visual when using the test module 60, while leaving the wiring, e.g., wiring to the second terminal 20*b* visually accessible. The test module 60 allows for a visual test of the main power connection without having to suspend the first housing 10 including the light engine/reflector from the ceiling while wired to the second housing 15. Prior to the methods and structures of the present disclosure, in some instances the ceiling is often left open for the wiring inspection. To verify functionality, and the power connection to the light fixture, in prior methods the whole reflector part of the downlight ends up dangling from the ceiling. For large sized downlights, that can be particularly dangerous. First, a large sized downlight can be a bulky and heavy structure, and it may potentially damage the wiring due to the stress on the wiring from the weight of the downlight. In some instances, the weight of the downlight can break the wire, wherein the downlight can then crash down to the floor. The reversible driver to light source connector 20 eliminates that situation, by separating the first housing 10 including the light engine/reflector from the second housing 15 including the main power connections, which are in the junction box 17 of the second housing 15. As depicted in FIGS. 10 and 12, the test module 60 is clearly visible on the room side of the ceiling for testing the power connection to the driver electronics that are contained in the second housing 15 that is mounted in the ceiling, without the first housing 10 being suspended from the ceiling by wiring, such as the wiring connecting the light source to the driver electronics.

In the depicted embodiments, the signal provided by the testing module 60 is a visual signal that is provided by a test light 64 having a light emitting diode. However, the test light 64 is not limited to only this type of bulb. Additionally, the test module 60 may not necessarily have a test light 64, as other signal structures are possible for indicating a positive test with the test module 60. A positive test could be an indication that the main power connection wiring 31 is properly connected to the junction box 17. A positive test could be the test light 64 lighting up. In other embodiments, instead of the test light, the test module 60 could emit an audible sound. In yet other embodiments, the test light 64 of the test module 60 may be substituted with a signal sending transmitter. The signal sending transmitter may send a signal of a good main power connection or a bad main power connection to an interface through which an installer is testing the installation, e.g., an application being run on a mobile computing device being used by the installer.

Figure 13A:
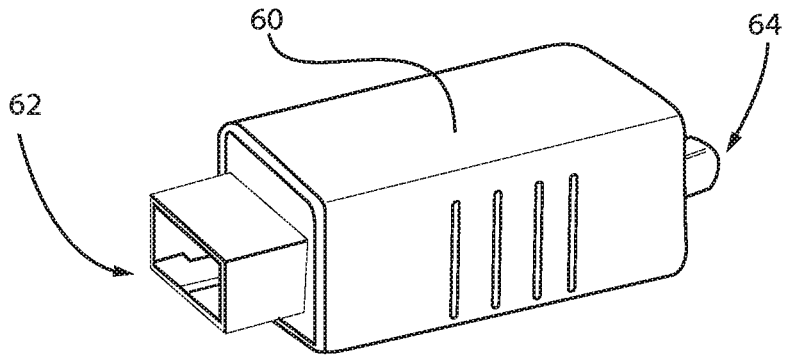
FIGS. 13A and 13B are perspective views of the testing module.
Figure 13B:
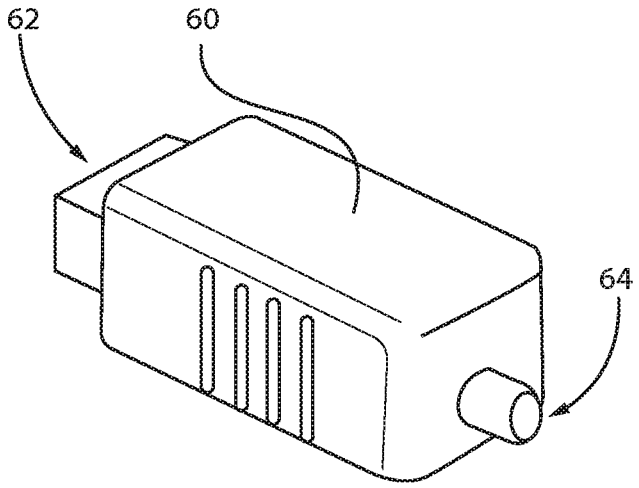
Figure 13C:
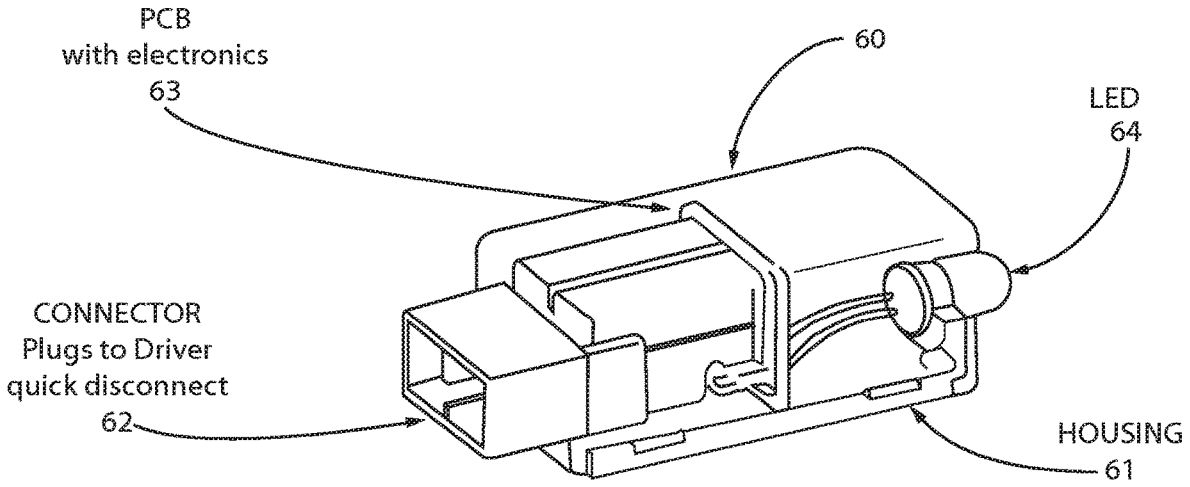
FIG. 13C is a sectioned view of the testing module illustrating the internal components of the testing module, in accordance with one embodiment of the present disclosure.
Figure 14:
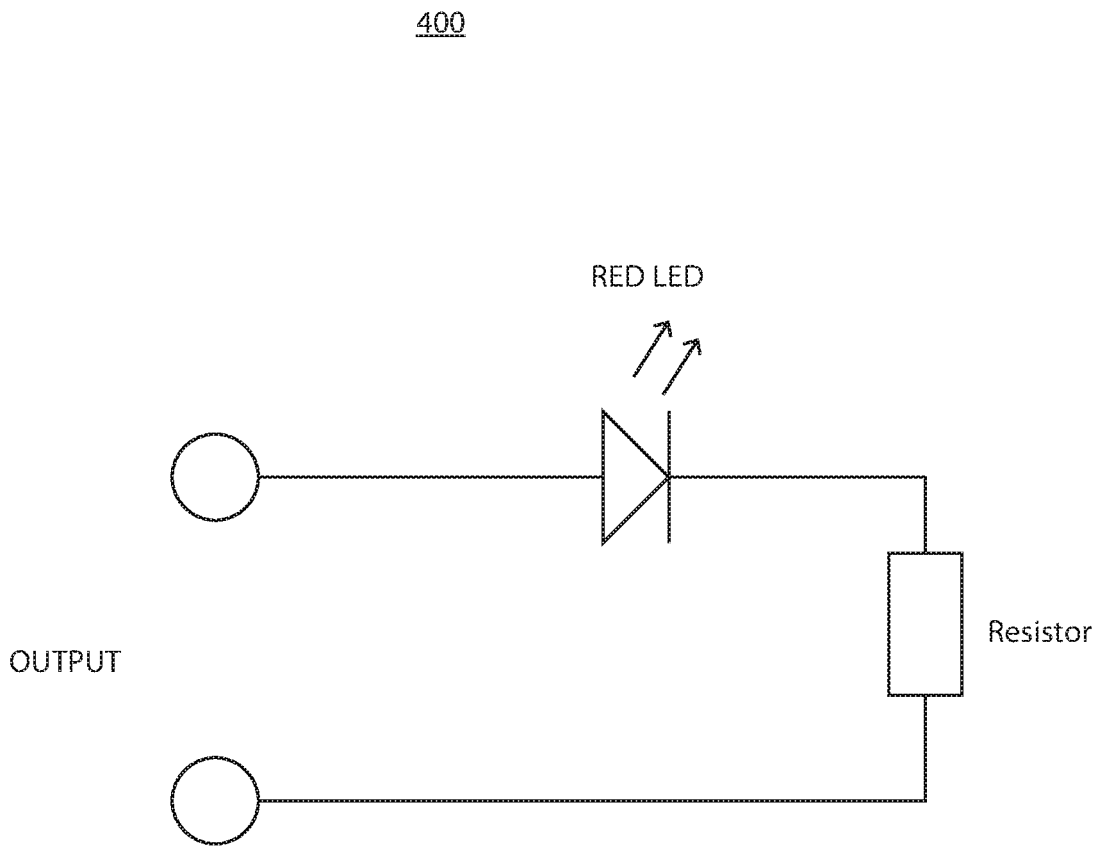
FIG. 14 is a circuit diagram for the electronics package of one embodiment of the downlight designs that is depicted in FIGS. 10-13C.

FIGS. 13A-13C depict one embodiment of the test module 60 disconnected from the second terminal 20*b*. The test module 60 includes a connector 62 through which the test module 60 is connected to the second terminal module 20*b* at a first end of the housing 61 of the test module 60, and a test light 64 present at an opposing second end of the housing 61. Contained within the housing 61 of the test module 60 is a printed circuit board (PCB) 63. In some embodiments, the printed circuit board (PCB) 63 may include the test circuit 400 that is depicted in FIG. 14. The test circuit may include a driver output terminal and a ground terminal at the connector 62 of the test module. Positioned between the driver output terminal and the ground terminal is a resistor and the test light 64, which are connected in series. It is noted that this is only one example of the circuit that can be present on the printed circuit board (PCB) 63, and that other embodiments have also been contemplated. In some embodiments, the test circuit is such that the output of the driver is converted to match the input requirement of the indicator LED, such as voltage and current limits.

Figure 15:
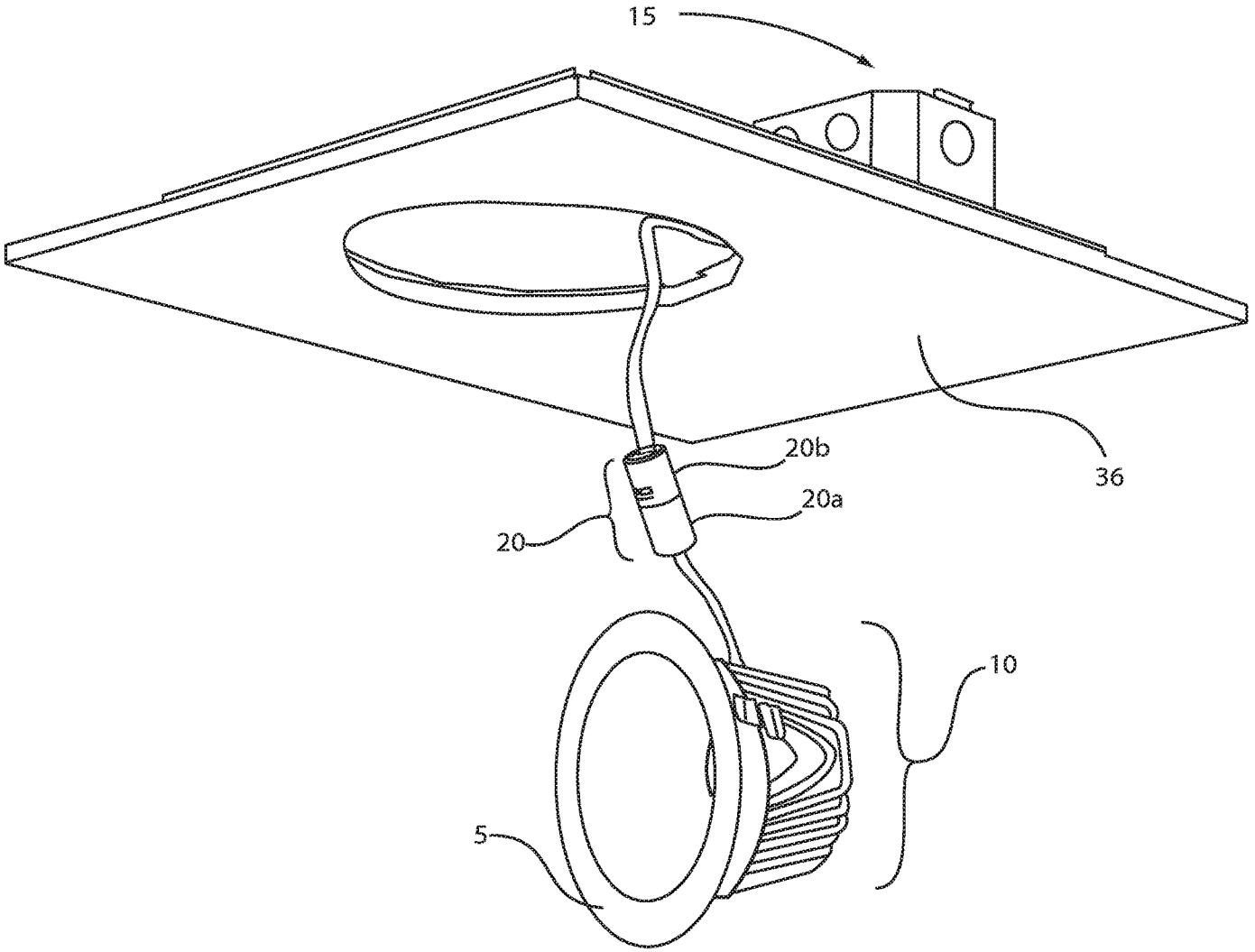
FIG. 15 is a perspective view of the power testing module being swapped with a terminal to the first housing including the light emitting diode (LED) light source.

FIG. 15 depicts removing the test module 60, e.g., after the test module 60 has signaled a proper main power connection, e.g., connection of the main power line 31 to the junction box 17 of the second housing 15, and replacing the test module 60 with a first terminal 20*a* of the first housing 10 including the light engine/reflector. In some embodiments, the first terminal 20*a* of the first housing 10 is connected to the second terminal 20*b* by twist connection when the first and second terminals 20*a*, 20*b* are mating twist connectors. The first housing 10 may then be installed into the ceiling providing a finalized installation.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGs. It will be understood that the spatially relative terms are intended to encompass different orientations of the device in use or operation in addition to the orientation depicted in the FIGs.

Having described preferred embodiments of a downlight having quick connect driver assembly with switch selectable light characteristics and test module it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A light structure comprising:

a first housing having a recessed down light structure geometry for containing a light emitting diode (LED) light source;

a second housing for containing driver electronics including an exterior switch mounted to the second housing for selecting lighting characteristics of light being projected by the light emitting diode (LED) light source; and a reversible driver to light source connector for electrically connecting the first housing containing the light emitting diode (LED) light source and the second housing including the driver electronics.

2. The light structure of claim 1, wherein the first housing and the second housing are physically separate structures.

3. The light structure of claim 2, wherein a first end of the reversible driver to light source connector is engaged to the light emitting diode (LED) light source through a first wired electrical pathway, and a second end of the reversible driver to light source connector is engaged to the driver electronics.

4. The light structure of claim 3, wherein the first end and second end of the reversible driver to light source connector is a twist connection.

5. The light structure of claim 1 further comprising a dimming circuit for dimming the light emitted by the lamp in response to signal from a 0-10V dimming switch.

6. The light structure recited in claim 1, wherein light emitting diodes for the light emitting diode (LED) light source are surface mount device (SMD) light emitting diodes (LED).

7. The light structure as recited claim 1, wherein the exterior switch for selecting lighting characteristics has three selectable settings of 700 LM, 900 LM and 1500 LM.

8. A light structure comprising:

a first housing having a recessed down light structure geometry for containing a light emitting diode (LED) light source;

a second housing containing driver electronics to power the light emitting diode (LED) light source and a junction box, the second housing being vertically orientated to provide that the driver electronics are positioned in a first level of the second housing and a junction box is present on a second level of the second housing to provide that a main power connection from the power source to the junction box and a driver to light source power connection are vertically offset from one another;

a reversible driver to light source connector for electrically connecting the first housing containing the light emitting diode (LED) light source and the second housing including the driver electronics; and a switch for selecting lighting characteristics of light mounted on an exterior wall of the second housing.

9. The light structure of claim 8 further comprising a dimming circuit for dimming the light emitted by the lamp in response to signal from a 0-10V dimming switch or a phase cut dimming switch.

10. The light structure recited in claim 8, wherein light emitting diodes for the light emitting diode (LED) light source are surface mount device (SMD) light emitting diodes (LED).

11. The light structure as recited claim 8, wherein the switch for selecting lighting characteristics has three selectable settings of 700 LM, 900 LM and 1500 LM.

12. The light structure as recited in claim 8, wherein the junction box further includes a connection for auxiliary power backup.

13. The light structure as recited in claim 12, wherein the auxiliary power backup is a battery backup.

14. The light structure as recited in claim 13, wherein the second housing is mounted to a back surface of the first housing so that the driver electronics is positioned between the junction box and the first housing.

15. The light structure as recited in claim 8, wherein the first housing is mounted to first portion of a mounting bracket affixed to a ceiling panel, and the second housing is mounted to a second portion of the mounting bracket that is affixed to the ceiling panel.

16. The method recited in claim 15, wherein the light engine includes light emitting diodes that are surface mount device (SMD) light emitting diodes (LED).

17. A lighting method comprising:

connecting a two level housing comprising a vertical stack of a driver electronics level and junction box level to a main power source in a ceiling mounted position, wherein the main power source is connected to a main power connector in the junction box level, and the driver electronics level includes a first terminal, wherein a switch for selecting lighting characteristics of light is mounted on an exterior wall of the two level housing;

connecting a second terminal of a light engine housing to the first terminal to the driver electronics in the two level housing, the first and second terminal electrically connected to provide that the driver electronics are in electrical communication with a light engine within the light engine housing; and mounting the light engine housing in the ceiling mounted position.

18. The method of claim 17, wherein the first terminal is in electrical communication to driver electronics in the driver electronics level by wired connection.

19. The method of claim 17, wherein the second terminal is in electrical communication to the light engine in the light engine housing by wired connection.

* * * * *